US007008021B2

(12) United States Patent
Schultz et al.

(10) Patent No.: US 7,008,021 B2
(45) Date of Patent: Mar. 7, 2006

(54) INTERIOR WELD AND IMPROVED SLING

(76) Inventors: Richard Schultz, 144 Hillcrest, Barto, PA (US) 19504; Peter Schultz, 144 Hillcrest Rd., Barto, PA (US) 19504

( * ) Notice: Subject to any disclaimer, the term of this patent is extended or adjusted under 35 U.S.C. 154(b) by 0 days.

(21) Appl. No.: 10/799,355

(22) Filed: Mar. 12, 2004

(65) Prior Publication Data

US 2005/0200189 A1 Sep. 15, 2005

(51) Int. Cl.
*A47C 31/02* (2006.01)
*A47C 7/02* (2006.01)

(52) U.S. Cl. ..... 297/452.56; 297/218.1; 297/218.3; 297/218.5; 24/71.1

(58) Field of Classification Search ..... 297/218.1, 297/218.3, 218.5, 452.56, 452.63, 452.64; 24/71.1

See application file for complete search history.

(56) References Cited

U.S. PATENT DOCUMENTS

| | | | | |
|---|---|---|---|---|
| 2,589,901 A * | 3/1952 | Van Doren | ..... | 297/218.5 X |
| 3,208,794 A * | 9/1965 | Gunn | ..... | 297/452.63 X |
| 3,289,220 A * | 12/1966 | Grimshaw | ..... | 297/452.56 X |
| 4,662,632 A * | 5/1987 | Bjorhn | ..... | 24/71.1 X |
| 6,113,186 A * | 9/2000 | Holmes et al. | ..... | 297/452.56 X |

* cited by examiner

*Primary Examiner*—Rodney B. White
(74) *Attorney, Agent, or Firm*—Thomas A. O'Rourke; Bodner & O'Rourke, LLP

(57) ABSTRACT

An interior weld for furniture having a tubular member is disclosed. The weld has a first tubular member and a second tubular member. The first tubular member is adapted to receive the tubular second member. An edge of the tubular second member contacts an inner surface of the first tubular member. A weld is formed on the inner surface of the first tubular member at the contact point where the second tubular member contacts the first tubular member. There is a weld at that contact point which immovably attaches the second member to the first member.

16 Claims, 5 Drawing Sheets

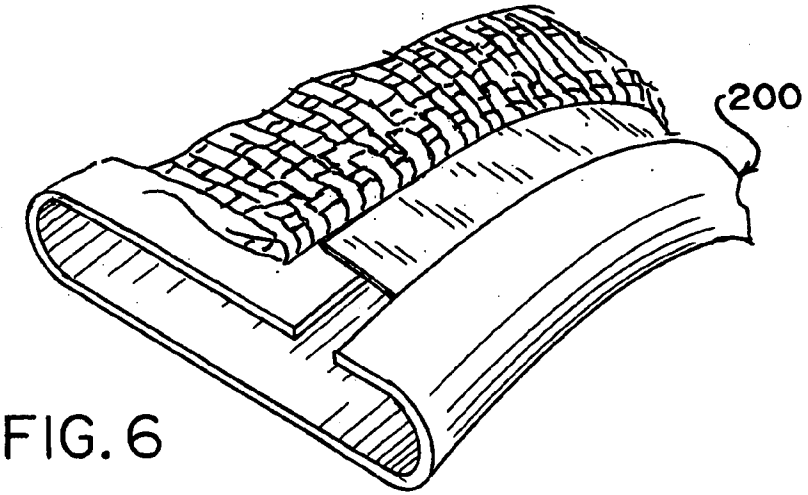
FIG. 6
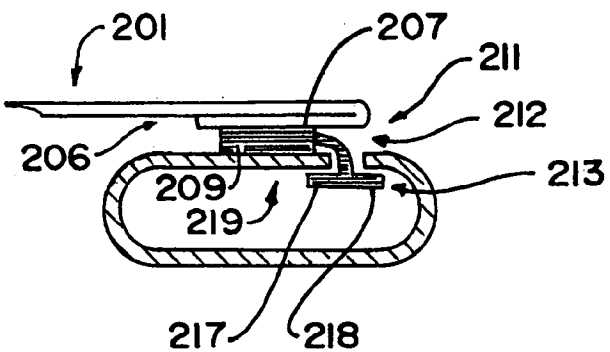
FIG. 8
FIG. 5
PRIOR ART
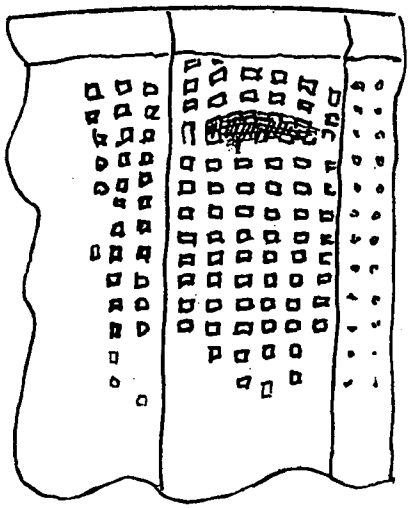
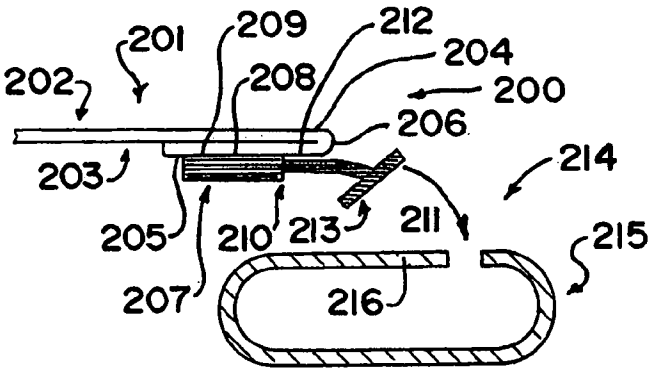
FIG. 7

INTERIOR WELD AND IMPROVED SLING

BACKGROUND OF THE INVENTION

The function and inner workings of any device are usually its most important attributes. Mechanical devices may employ a series of gears and belts or chains. Electrical devices may utilize resistors, capacitors and inductors connected in series or in parallel. Devices which require chemical combination or interaction may use catalysts or inhibitors. These devices are usually purchased solely for the purpose they are intended to fulfill or task they accomplish.

While gears, electronics, or chemicals may provide performance for a device, many consumers look beyond function to appearance. Aesthetic value has become one of the main considerations in consumer purchasing. For example, car manufacturers will sell the fiberglass bodies of normally expensive vehicles which can be fitted over stock engines. Hence, a consumer can appear to have purchased a brand-new luxury automobile, when, in fact a fiberglass body has been placed over an old engine and old parts.

Virtually every product has an aesthetic component. One of the most common categories of products in which aesthetic value has somewhat surpassed function is furniture. Many homeowners purchase chairs and tables based on a color scheme or theme of the room or house. Additionally, furniture for indoor use is vastly different then that for outdoor use, mainly in appearance and material; but, the function remains the same. For example, a chair for indoor use may have a wood frame and cushions covered in cloth. Whereas, an outdoor chair may be a solitary plastic or metal frame, possibly with canvas, which can be left outside during rainstorms or inclement weather, without deforming or breaking. While outdoor furniture must have a durability and weather resistant factor, appearance and craftsmanship do play a significant role in the purchasing decisions.

Typically, outdoor furniture, tables and chairs, is manufactured out of plastic, metal or a metal alloy. The chairs are usually constructed out of hollow members which form a frame. The hollow nature of the frame makes the chairs lightweight and easily transportable. While plastic may be more lightweight and cheaper to manufacture, it is easily deformable from overuse and can stain. These qualities of plastic outdoor furniture make it less desirable than metal furniture. However, plastic furniture can be manufactured from a single sheet. Whereas, metal furniture typically must be assembled by welding a variety of pieces together. Also, metal furniture typically employs a sling, netting or mesh that serves as the back and seat portions of the chair.

The site of an external weld can be an eyesore and significantly decrease the aesthetic value of a piece of furniture. An exterior weld gives off a messy finish to an otherwise sleek piece of furniture. For example, at a junction of two smooth, stainless steel tubes, an exterior weld will give the appearance of an unclean fit. Hence, there is a need for an interior weld that will give the appearance of a smooth fit at junctions on metal furniture.

Additionally, typical metal outdoor furniture employs a sling for the back and seat portions of the chair. This sling may be one or two pieces. The sling typically attaches to the frame of the chair through a series of sewn pockets. The frame members fit within these pockets. However, as time goes by, the sling begins to sag, which results in replacing the sling, if possible, or purchasing a new chair. Hence, there is a need for a sling which is easily replaceable and easily attachable to the frame of a metal chair and can be tightened if it begins to sag.

OBJECTS OF THE INVENTION

It is an object of the present invention to provide an interior weld for junctions of members on furniture.

It is an object of the present invention to provide an interior weld which will increase the aesthetic value of furniture.

It is an object of the present invention to provide an interior weld which will provide a smooth finish at the connection point of frame members on a piece of furniture.

It is an object of the present invention to provide an improved sling which can fit easily into the frame of a piece of furniture.

It is an object of the present invention to provide an improved sling which can be easily replaced.

It is an object of the present invention to provide an improved sling which can be tightened.

SUMMARY OF THE INVENTION

One embodiment of the present invention is directed to an interior weld. The interior weld can be comprised of a first member and a second member. The first member can be a tubular part of the frame of a piece of furniture. The first member may be adapted to receive the second member. Preferably, the first member will have a hole which receives the second member. The second member can be inserted into the hole until it contacts an inner surface of the first member. Preferably, the first member has a greater radius than the second member. At a point where the second member contacts the inner surface of the first member, a weld may immovably connect the first and second members.

In an alternative embodiment, a first member may be adapted to receive any number of additional members. In this embodiment, the additional members may not contact the inner surface of the first member. In this embodiment, the additional members may have a weld which connects them inside the first member.

Another embodiment of the present invention is directed to an improved sling. The improved sling may comprise a sling, which can be a cloth mesh or any suitable material that might be used as a back and/or seat of a chair or other piece of furniture. The sling may be connected to a runner. Preferably, the sling is sewn to the runner. However, any other suitable attachment method, such as adhesive or staples may be used. The runner may attach to the full length of the sling along its edges. Also, runners may be on the top and bottom edges of the sling.

Elastically attached to the runner may be a connection means. Preferably, the connections means has an extension member and a flange member. The flange member may be adapted to fit within a slot of a member of the frame of a chair. Preferably, the connecting means can be slid into place, which provides for easy attachment and removal. Also, the sewn attachment of the sling to the runner will give the sling a clean look, rather than the bulky appearance of tubular membranes with pockets of the sling.

Also, the improved sling can overcome the problem of deformation due to overuse or use over an extended time. In this further embodiment, the improved sling can comprise a threaded knob on the inside of the frame of a chair. Attached to the threaded knob can be a threaded member, which preferably has threads that mate with the threads of the threaded knob. The threaded member can fit within a hole on the frame of the chair and attach to the threaded knob. A portion of the threaded member may remain outside of the frame of the chair.

Preferably attached to the portion outside the frame of the chair of the threaded member is a connector member. A portion of the connector member can fit over the outside of the threaded member which is inside the frame of the chair. An outer portion of the connector member can be threaded and adapted to receive a tightening member. Preferably, the tightening member is a screw, bolt, or other suitable item. On a surface of the connector member can be the attachment frame. The attachment frame can be adapted to receive a runner that may be attached to the sling. In operation, the tightening member can be turned which can move the connector member over the threaded member. As the connector member moves inwardly over the threaded member, the attachment frame will pull the sling in a generally outward direction, making it taut.

BRIEF DESCRIPTION OF THE DRAWINGS

FIG. 5 is a front view of the prior art sling.

FIG. 6 is a perspective view of the sling of the present invention.

FIG. 7 is a side view of the sling of FIG. 6.

FIG. 8 is a side view of the sling of FIG. 7.

DETAILED DESCRIPTION OF THE DRAWINGS

Figure 1:
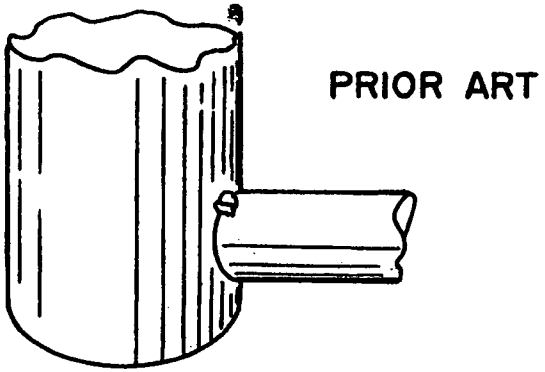
PRIOR ART FIG. 1
FIG. 1 is a perspective view of the prior art exterior weld.
Figure 2:
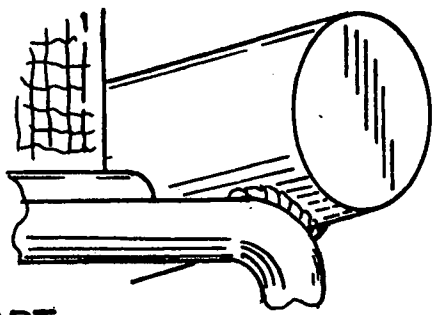
PRIOR ART FIG. 2
FIG. 2 is a perspective view of the prior art exterior weld.

A typical example of an exterior weld of the prior art can be seen in FIGS. 1 and 2. In both prior art exterior welds, there is a non-uniform communication of the members of the frame at the welding point. In these exterior welds the soldering material tends to be lumped around the junction of the members being joined. The present invention is directed to an interior weld which provides a smooth junction of members of a frame of a piece of furniture or other device. The present invention has particular application to high end furniture, bicycles and other products where clean weld lines are desirable.

Figure 3:
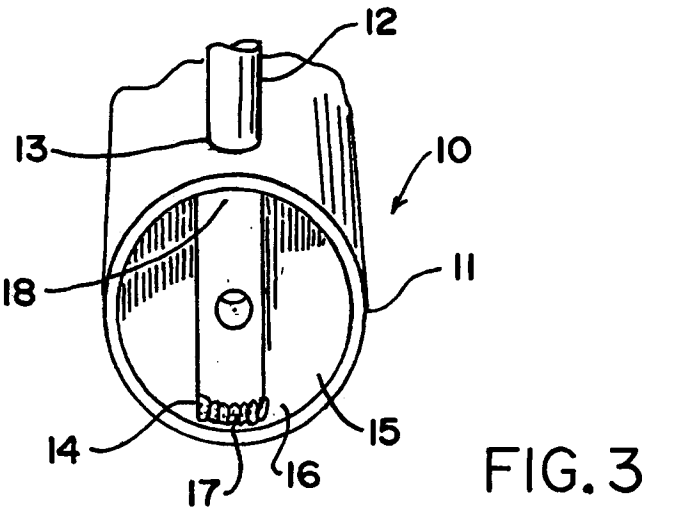
FIG. 3 is a perspective view of the interior weld of the present invention.

As seen in FIG. 3, one embodiment of the interior weld 10 is viewed. A first frame member 11 can be adapted to receive a second frame member 12. Preferably, first frame 11, which is adapted to receive second frame member 12, has a larger radius than second frame member 12. Each frame member may be of any shape or size. Preferably, both frame members are tubular. In one embodiment, both tubular members have the same shaped cross section.

First frame member 11 may have an orifice or hole 13, in which second frame member 12 may fit. Depending on the shape of the second frame member 12, the hole 13 may be circular, square or any shape of the second frame member 12.

When the second frame member 12 is passed through hole 13, edge 14 of second frame member 12 may contact an inner surface 15 of the first frame member 11. At first contact point 16, a weld 17 may be placed to attach immovably second frame member 12 to first frame member 11. In another embodiment, a weld (not shown) may be placed at second contact point 18. Alternatively, welds at both contact points may be employed for added support and strength at the joint. Also, these additional welds may prevent slipping or twisting of second frame member 12 within hole 13.

Figure 4:
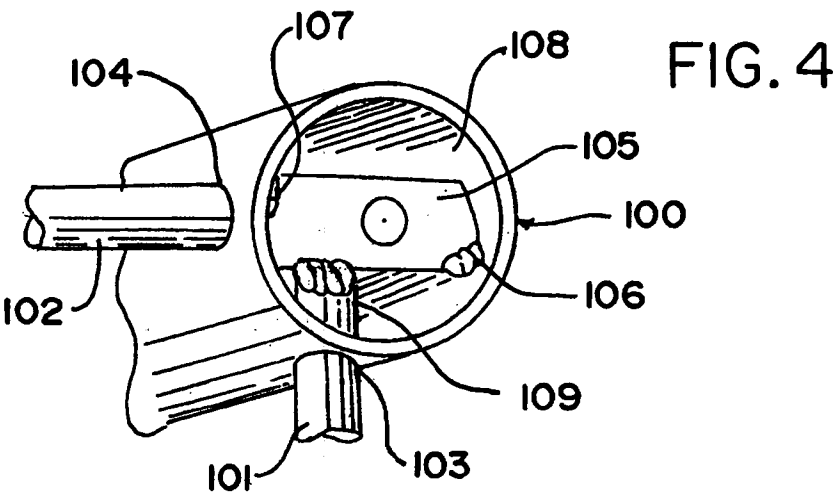
FIG. 4 is a perspective view of another embodiment of the interior weld of the present invention.

In another embodiment, as seen in FIG. 4, first frame member 100 is adapted to receive a second frame member 101 and a third frame member 102. Second frame member 101 may be received by a first hold 103 and third frame member 102 may be received by a second hole 104. Again, the size and shape of the holes can depend on the size and shape of the frame members.

An attachment bar 105 may be adapted to contact second frame member 101 and third frame member 102. Attachment bar 105 may have first weld 106 and a second weld 107 to an inner surface 108 of first frame member 100. Also, attachment bar may have a third weld 109, which connects to second frame member 101. A fourth weld (not shown) may connect attachment bar 105 to third frame member 102.

It is understood that a first frame member may be adapted to receive any number of additional frame members. Also, the additional frame members may attach by weld to an inner surface of the first frame member, to an attachment bar within the first frame member, or in any other suitable manner that would be consistent with an interior weld.

The sling of the prior art is shown in FIG. 5. The pockets of the prior art sling present a bulky and unfinished look. As seen in FIG. 6, an improved sling 200 may overcome the disadvantages of the prior art.

As seen in FIG. 7, the improved sling assembly 200 may comprise a sling 201. Sling 201 may be composed of any suitable material, such as cloth, rubber, wire mesh, etc. Sling 201 may be defined as having a top surface 202 and a bottom surface 203. A score line 204, crease or fold may be present. The sling 201 may be folded back on itself along score line 204. In this manner, a bottom surface 205 of folded portion 206 may contact bottom surface 203 of sling 201.

When folded portion 206 is beneath sling 201, a runner 207 may be attached to folded portion 206. Runner 207 may have a top surface 208 that can attach to top surface 209 of folded portion 206. The method of attachment of runner 207 to folded portion 206 may also incorporate sling 201. Attachment may be by staple, adhesive or stitching.

On a side surface 210 of runner 207 may be a connection means 211. Connection means 211 is preferably composed of an extension member 212 and a flange 213. The runner 207 and connection means 211 may be composed of the same material or a composite of materials. Preferably, the runner 207 and connection means 211 are a solitary piece of plastic or rubber.

Also, as seen in FIG. 7, a slot 214 for receiving connecting means 211 can be cut into a frame member 215. Frame member 215 may be any shape provided it incorporates a slot 214. Preferably, frame member 215 has an oval cross-section with a slot 214 in top surface 216.

As seen in FIG. 8, flange 213 can be received by slot 214. In this manner, flange 213 has circulation surfaces 217 and 218, which may contact the inner surface 219 of frame member 215. Extension member 212 can reside in the slot 214 when flange 213 is inside frame member 215. Also, runner 207 may be in contact with top surface 216 of member 215. Preferably, extension member is taught when the flange is inside the frame member, and the runner is contacting the frame member, thereby providing for a tight sling.

Use of the improved sling of the present invention can also aid in cleaning and removal. For example, if the sling is cotton and becomes stained, it may be removed and put in a washing machine. Also, this will not damage the improved sling because the runner and connection means are preferably made out of plastic.

Figure 10:
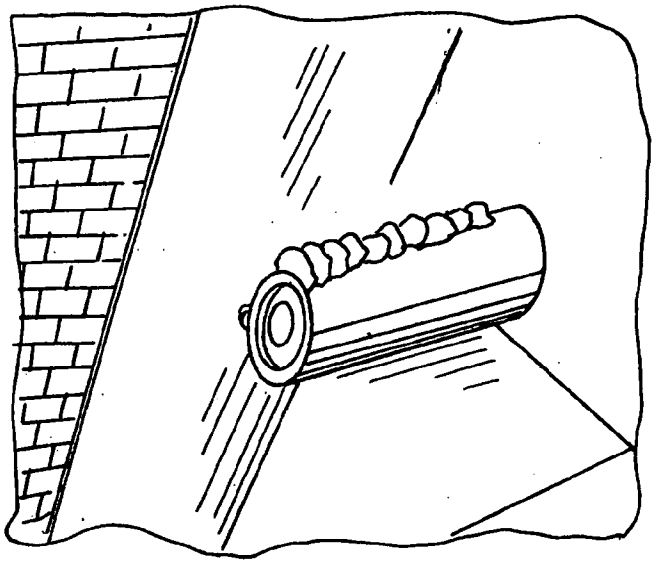
FIG. 10 is a perspective view of the sling tightening mechanism of the improved sling of the present invention in use on a chair.
Figure 9:
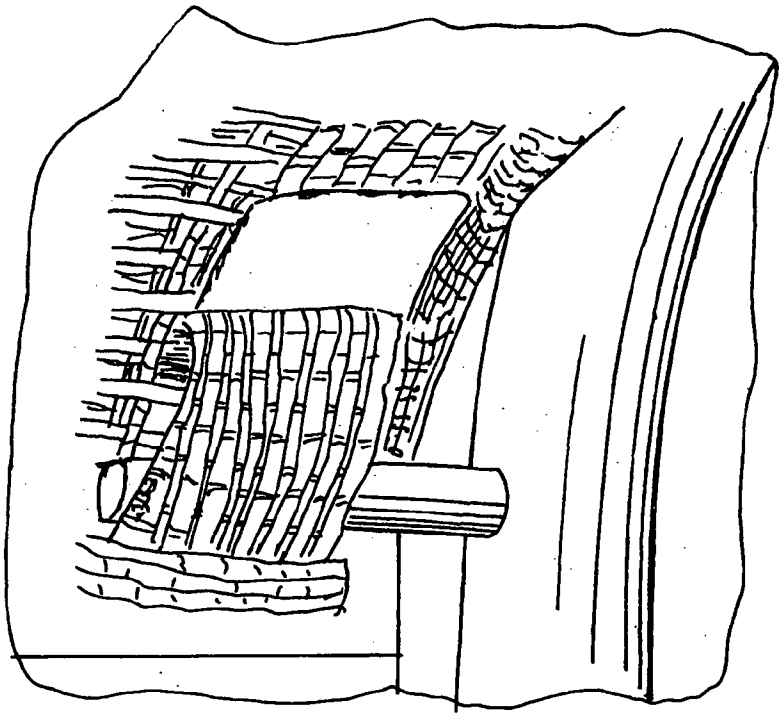
FIG. 9 PRIOR ART
FIG. 9 is a perspective view of the prior art sling attachment.

As seen in FIG. 9, the prior art sling attaches to the furniture frame by a loop and patch. This is undesirable because the sling will inevitably deform from use. Hence, FIG. 10 shows an sling tightening means of the present invention for use on the frame of a piece of furniture which would use a sling as a backing or seating, such as a chair, stool, chaise lounge, or other pieces that might hold a person.

Figure 11:
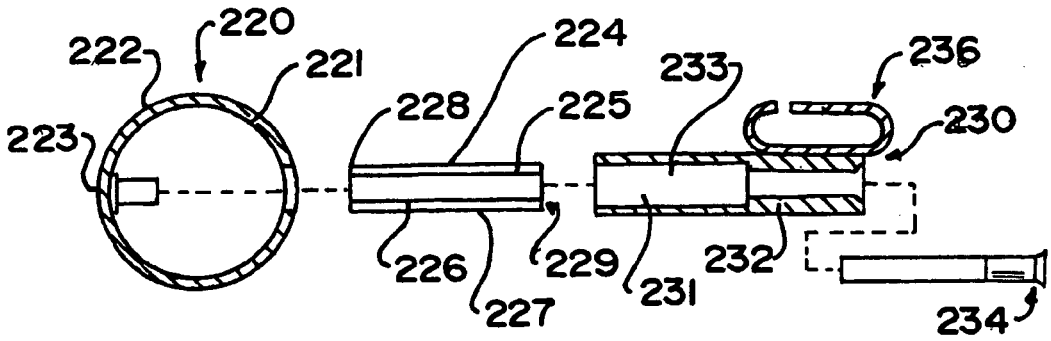
FIG. 11 is an exploded view of the sling tightening mechanism of the improved sling of the present invention.

FIG. 11 shows an exploded view of an embodiment of the sling tightening mechanism of the present invention. A frame 220 of a piece of furniture, such as a chair, can be defined as having an inner surface 221 and an outer surface 222. Frame 220 can be any shape that would be used as the frame of a piece of furniture, such as a cylinder, tube, box, etc. On inner surface 221 of frame 220 can be a knob 223. In one embodiment knob 223 is threaded and adapted to receive a threaded member 224.

Threaded member 224 is preferably a hollow cylinder defined by a sidewall 225 with an inner surface 226 and an outer surface 227. One end 228 of threaded member 224 can be adapted to mate with knob 223. A second end 229 of threaded member 224 can be housed in connector member 230. Connector member 230 is preferably composed of a smooth portion 231 and a threaded portion 232. Smooth portion can be adapted to receive threaded member 224. In this manner, threaded member 224 preferably has a smaller radius than smooth portion 231 of connector member 230, such that threaded member 224 may fit within connector member 230. An inner surface 233 of smooth portion 231 can contact outer surface 222 of threaded member 224. Threaded portion 232 can receive a tightening means 234, such as a screw. An outer surface 235 of connector member 230 may have an attachment frame 236 attached thereto. Attachment frame 236 may receive a runner, which is attached to a sling (not shown).

Figure 12:
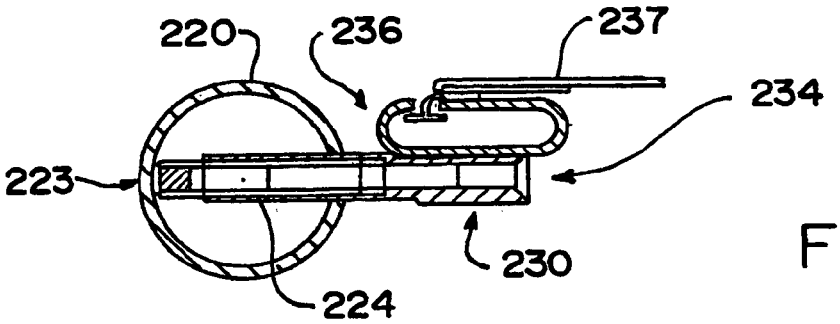
FIG. 12 is an assembled view of the sling tightening mechanism of the improved sling of the embodiment in FIG. 11.

As seen in FIG. 12, the assembled tightening mechanism can be operated by rotation of the tightening means 234. When the sling 237 becomes deformed or begins to sag, the owner can rotate the tightening means 234. When the tightening means 234 is rotated, the connector member 230 is forced inward, over the threaded member 224 towards the frame 220 of the piece of furniture. As the connector member 230 moves toward the frame 220, the attachment frame 236 can pull the sling 237 taut.

Figure 13:
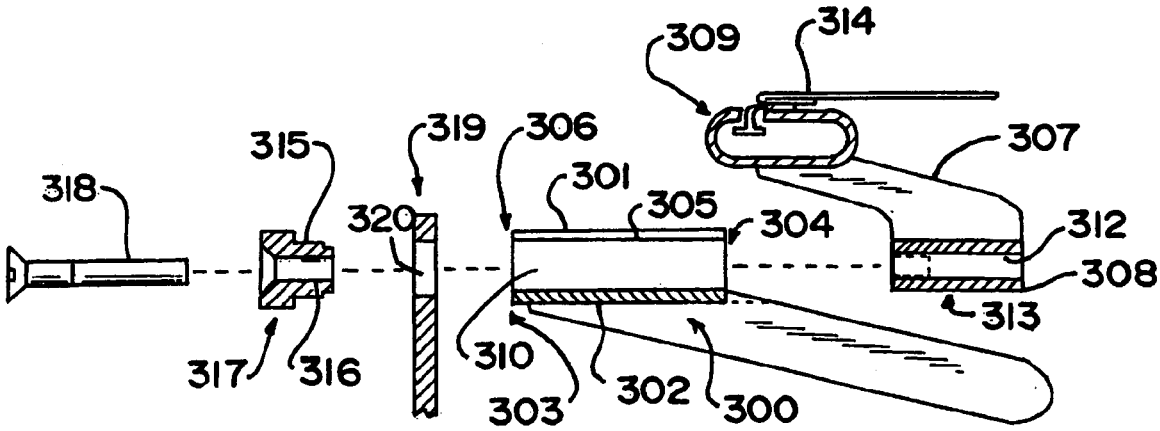
FIG. 13 is an exploded view of an alternative embodiment of the sling tightening mechanism of the improved sling of the present invention.

FIG. 13 shows an alternative embodiment of the sling tightening mechanism of the present invention. In this embodiment, the frame 300 of a piece of furniture may have a connector member 301 attached to it. Connector member 301 may have a sidewall 302 and a first end 303 and a second end 304. Also, connector member 301 may have a slot 305 on a generally upper portion 306 of sidewall 202.

Slot 305 on connector member 301 can be adapted to receive fin 307 in second end 304. On a first end of fin 307 a threaded member 308 can be attached, and on a second end of fin 307 an attachment frame 309 can be attached. Slot 305 allows threaded member to ride along an inner surface 310 of sidewall 302 of connector member 301. Preferably, threaded member has a sidewall 311 with a threaded inner surface 312 and a smooth outer surface 313. Smooth outer surface 313 allows for frictionless movement of threaded member 308 within connector member 301. Attachment frame 309 can hold sling 314.

Attached to first end 303 of connector member 301 can be a connection cap 315. Connection cap 315 can be immovably attached to the first end 303 of connector member 301. Connection cap 315 can have a threaded inner surface 316 and a smooth outer surface 317. The threaded inner surface 316 can be adapted to mate with a tightening means 318, such as a screw, bolt, etc. Connection cap 315 can be first attached to a support bar 319, and the support bar 319 can be attached to the connector member 301. Support bar 319 can be generally defined as a slender, rod-shaped member with a hole 320, which can receive connection cap 315.

Figure 14:
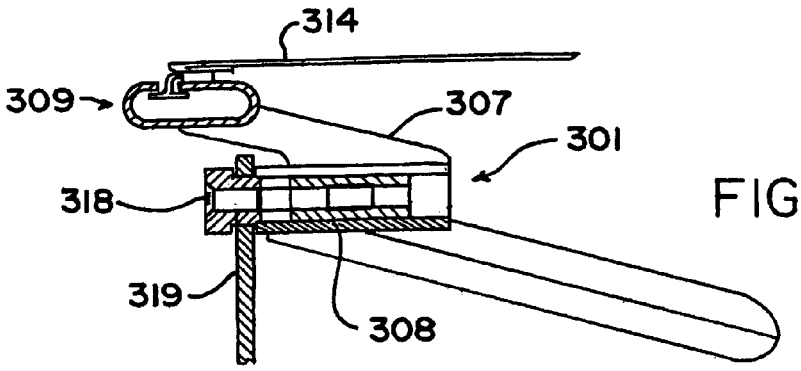
FIG. 14 is an assembled view of the sling tightening mechanism of the improved sling of the embodiment in FIG. 13.

As seen in FIG. 14, tightening means 318 can fit through connection cap 315 into a portion of threaded member 308. In this manner, when the sling 314 becomes deformed or begins to sag, the tightening means 318 can be rotated. Rotation of the tightening means 318 can pull the threaded member 308 toward support bar 319. As threaded member 308 moves toward support bar 319, fin 307 will move attachment frame 309 generally in the same direction as threaded member 308. The resultant movement can operate to pull the sling taut.

Figure 15:
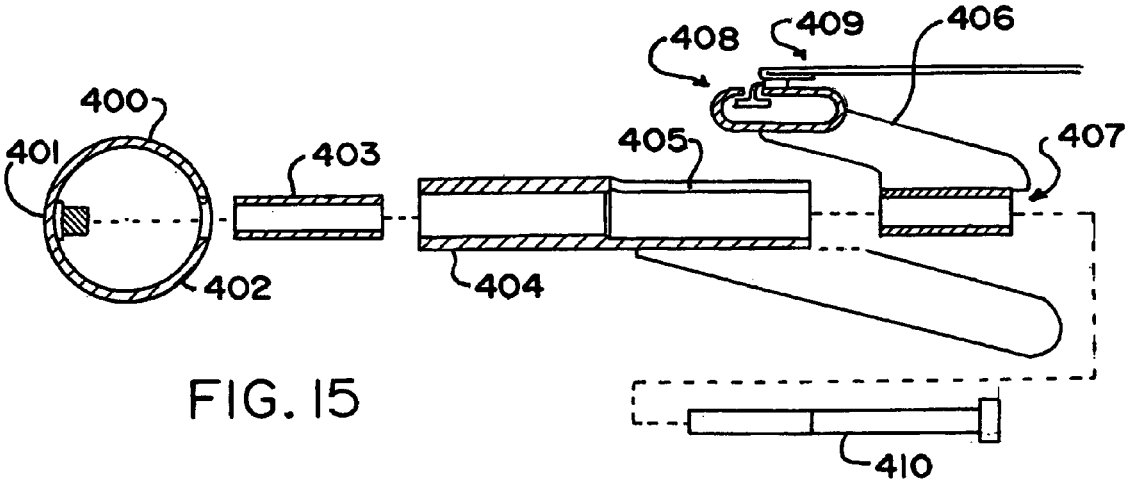
FIG. 15 is an exploded view of a further alternative embodiment of the sling tightening mechanism of the improved sling of the present invention.

FIG. 15 shows a further embodiment of the sling tightening mechanism of the present invention. This embodiment can generally be defined as a combination of elements of the previously defined embodiments. In this embodiment, the frame 400 of a piece of furniture can have a knob 401 and a hole 402. Hole 402 can be adapted to receive a first threaded member 403, which can mate with knob 401. Connector member 404 can slide over first threaded member 403 into hole 402. Connector member 404 can have a slot 405 in a generally upper portion of the connector member. Slot 405 can be adapted to receive a fin 406, which can attach a second threaded member 407 to an attachment frame 408. Attachment frame 408 can hold sling 409. A tightening means 410 can be inserted into the second threaded member 407 through connector member 404 and into the first threaded member 403.

Figure 16:
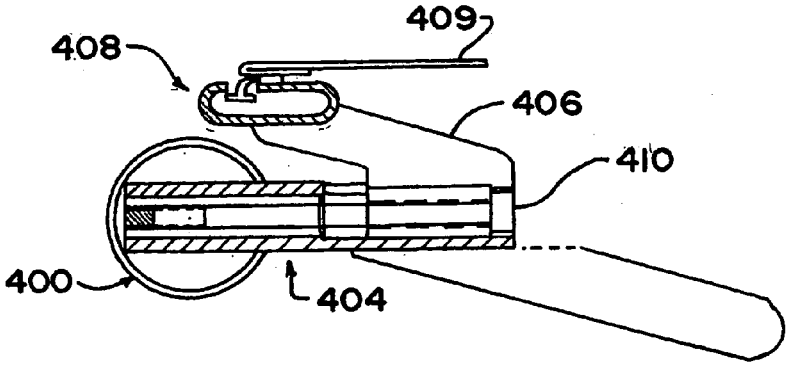
FIG. 16 is an assembled view of the sling tightening mechanism of the improved sling of the embodiment in FIG. 15.

As seen in FIG. 16, the rotation of tightening means 410 will move second threaded member 407 along slot 405. The movement of the second threaded member 407 can pull the sling taut.

What is claimed is:

1. A sling tightening mechanism comprising:

a frame of a piece of furniture, said frame having an outer surface and an inner surface, said frame being a generally hollow member, said frame having an opening in said outer surface;

a knob on said inner surface of said hollow member, said knob aligning generally with said opening in said frame;

a threaded member, said threaded member having a first end and a second end, said first end of said threaded member adapted to be connected to said knob;

a generally hollow connector member, said connector member having a first end and a second end, said first end of said connector member adopted to receive said second end of said threaded member, said connector member having an outer surface and an inner surface, said second end of said connector member extending from the outer surface of said frame;

an attachment frame attached to said outer surface of said connector member, said attachment frame adapted to hold a sling; and a tightening means, said tightening means received by said connector member and said threaded member, said tightening means rotatable, and pushing said connector member over said threaded member making said sling taut when said tightening means is rotated.

2. The sling tightening mechanism according to claim 1 wherein said knob is threaded.

3. The sling tightening mechanism according to claim 2 wherein said threaded member is cylindrical.

4. The sling tightening mechanism according to claim 3 wherein said connector member is cylindrical.

5. The sling tightening mechanism according to claim 4 wherein said inner surface of said first end of said connector member is smooth.

6. The sling tightening mechanism according to claim 5 wherein said inner surface of said connector member is threaded.

7. The sling tightening mechanism according to claim 6 wherein said tightening means is a screw.

8. The sling tightening mechanism according to claim 6 wherein said tightening means is a bolt.

9. A sling tightening mechanism comprising;

a frame of a piece of furniture, said frame having an outer surface and an inner surface, said frame having an opening, said frame having a knob on said inner surface of said frame generally aligned with said opening in said frame;

a connector member, said connector member having a first end and a second end, said first end of said connector member adapted to be inserted into said opening on said frame; said connector member having an outer surface and an inner surface;

an attachment frame removably connected to said second end of said connector member, said attachment frame adapted to hold a sling, said attachment frame having a member with an orifice therein;

a tightening means, said tightening means received by said connector member and said opening in said frame member, said tightening means tightening said sling as said tightening means is rotated.

10. The sling tightening mechanism of claim 9 further comprising:

a threaded member, said threaded member having a first end and a second end, said first end of said threaded member adapted to receive said knob; said second end of said threaded member being adapted to be inserted into said first end of said connector member; and said connector member being adapted to receive said second end of said threaded member.

11. The sling tightening mechanism according to claim 10 wherein said threaded member is secured to said knob by the threads on said knob.

12. The sling according to claim 11 wherein said tightening means is secured to said threads on said threaded member.

13. The sling tightening mechanism of claim 9 further comprising:

a slot in said second end of said connector member adopted to receives a portion of said attachment frame.

14. The sling tightening mechanism of claim 9 further comprising:

a slot in said attachment frame being adapted to receive a connection means attached to said sling.

15. The sling tightening mechanism of claim 14 wherein:

said connection means has a length generally at least the width of the sling such that when said tightening means is adjusted, the tension in said sling is changed uniformly across the width of said sling.

16. The sling tightening mechanism of claim 15 further comprising:

said connection means having an extension member and a flange extending from said extension member said connection means being disposed on a runner which is attached to said sling.

* * * * *